US011794492B2

(12) United States Patent
Sanada

(10) Patent No.: US 11,794,492 B2
(45) Date of Patent: Oct. 24, 2023

(54) PORTABLE MINIATURIZED PRINTER DEVICE

(71) Applicant: TOSHIBA TEC KABUSHIKI KAISHA, Tokyo (JP)

(72) Inventor: Tsuyoshi Sanada, Susono Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/583,457

(22) Filed: Jan. 25, 2022

(65) Prior Publication Data

US 2022/0305814 A1 Sep. 29, 2022

(30) Foreign Application Priority Data

Mar. 23, 2021 (JP) ..... 2021-048228

(51) Int. Cl.

| | |
|---|---|
| ***B41J 11/00*** | (2006.01) |
| ***B41J 3/36*** | (2006.01) |
| ***B41J 15/04*** | (2006.01) |
| ***B65H 23/032*** | (2006.01) |

(52) U.S. Cl.

CPC ..... *B41J 11/0045* (2013.01); *B41J 3/36* (2013.01); *B41J 15/042* (2013.01); *B65H 23/0322* (2013.01); *B65H 2301/41346* (2013.01); *B65H 2301/4421* (2013.01); *B65H 2403/411* (2013.01); *B65H 2511/12* (2013.01); *B65H 2801/12* (2013.01)

(58) Field of Classification Search

CPC . B41J 11/0045; B41J 15/042; B65H 23/0322; B65H 2301/41346; B65H 2301/4421; B65H 2403/411; B65H 2511/12; B65H 2801/12

See application file for complete search history.

(56) References Cited

U.S. PATENT DOCUMENTS

2013/0278702 A1 10/2013 Ishii et al.
2018/0297380 A1* 10/2018 Ikemoto ..... B65H 16/06

* cited by examiner

*Primary Examiner* — Henok D Legesse
(74) *Attorney, Agent, or Firm* — AMIN, TUROCY & WATSON, LLP

(57) ABSTRACT

A printer device includes: a pair of rack gears arranged in a staircase-like shape on a paper conveyance direction side of a continuous paper accommodated in a recessed accommodation part that accommodates a roll-shaped continuous paper and having tooth rows arranged in a first direction orthogonal to the paper conveyance direction so as to face each other; a pinion gear fitted into the tooth rows; and a pair of paper guides that are respectively provided at a position of an upper rack gear that is closer to a center side in the first direction from one end portion in the first direction and a position of a lower rack gear that is closer to the center side in the first direction from another end portion in the first direction or the other end portion. The paper guide provided on the upper rack gear is mounted to an upper mounting part extending from a back surface of the upper rack gear opposite to the tooth row to the paper conveyance direction side.

20 Claims, 11 Drawing Sheets

PORTABLE MINIATURIZED PRINTER DEVICE

CROSS-REFERENCE TO RELATED APPLICATION

This application is based upon and claims the benefit of priority from Japanese Patent Application No. 2021-048228, filed on Mar. 23, 2021, the entire contents of which are incorporated herein by reference.

FIELD

Embodiments described herein relate to a printer device, a thermal printer, and a portable printer.

BACKGROUND

In the related art, there is a printer device that prints information on a recording medium (hereinafter, referred to as roll paper) which is a roll-shaped continuous paper such as a label or a receipt. In the printer device, an accommodation part (hereinafter, referred to as a hopper) for accommodating and holding the continuous paper is rotatably supported at a central portion (hereinafter, referred to as a core portion) of winding of the continuous paper. In the hopper, a support member that supports the core portion has a convex portion that can be inserted into an inner circumference of the core portion. For example, the hopper has a pair of paper guides that regulate movement of the continuous paper along a width direction of the continuous paper. Each of the pair of paper guides is provided with the support member. The pair of paper guides are provided on the hopper so as to face two side surfaces of the continuous paper and be movable in conjunction with the width direction of the continuous paper. As a result, the pair of paper guides support the core portion so that a central portion of the continuous paper in the width direction is aligned with a central portion of a print area in the printer device.

In order to move the paper guides smoothly, it is essential to operate a portion close to a sliding portion (sliding part) of the paper guides. Therefore, after the roll paper is set, an operation part of the paper guides must be arranged at a position where the operation part does not interfere with the roll paper. However, when the operation part is arranged away from the sliding part, there is a drawback (problem) that the paper guides do not move smoothly. In addition, when the operation part is arranged close to the sliding part, in order to operate the operation part after setting the roll paper, it is necessary to widen the width direction of a printer in order to secure a portion for inserting a finger of a user, which results in a failure in miniaturization of the printer.

DETAILED DESCRIPTION

In general, according to one embodiment, a printer device in which an operation part is installed in the vicinity of a sliding part and a printer can be miniaturized is provided.

A printer device according to an embodiment includes a recessed accommodation part, a pair of rack gears, a pinion gear, and a pair of paper guides. The recessed accommodation part accommodates a roll-shaped continuous paper. The pair of rack gears are arranged in a staircase-like shape on a paper conveyance direction side of the continuous paper accommodated in the accommodation part, and have tooth rows arranged in a first direction orthogonal to the paper conveyance direction so as to face each other. The pinion gear is arranged between the pair of rack gears and fits into the tooth rows of the pair of rack gears. The pair of paper guides are respectively provided at a position of an upper rack gear of the pair of rack gears that is closer to a center side in the first direction from one end portion in the first direction and a position of a lower rack gear of the pair of rack gears that is closer to the center side in the first direction from another end portion in the first direction or the other end portion, and support side surfaces of the continuous paper accommodated in the accommodation part by an opening or closing movement in the first direction by the pair of rack gears and the pinion gear. The paper guide of the pair of paper guides, which is provided on the upper rack gear, is mounted to an upper mounting part extending from a back surface of the upper rack gear opposite to the tooth row to the paper conveyance direction side.

Figure 1:
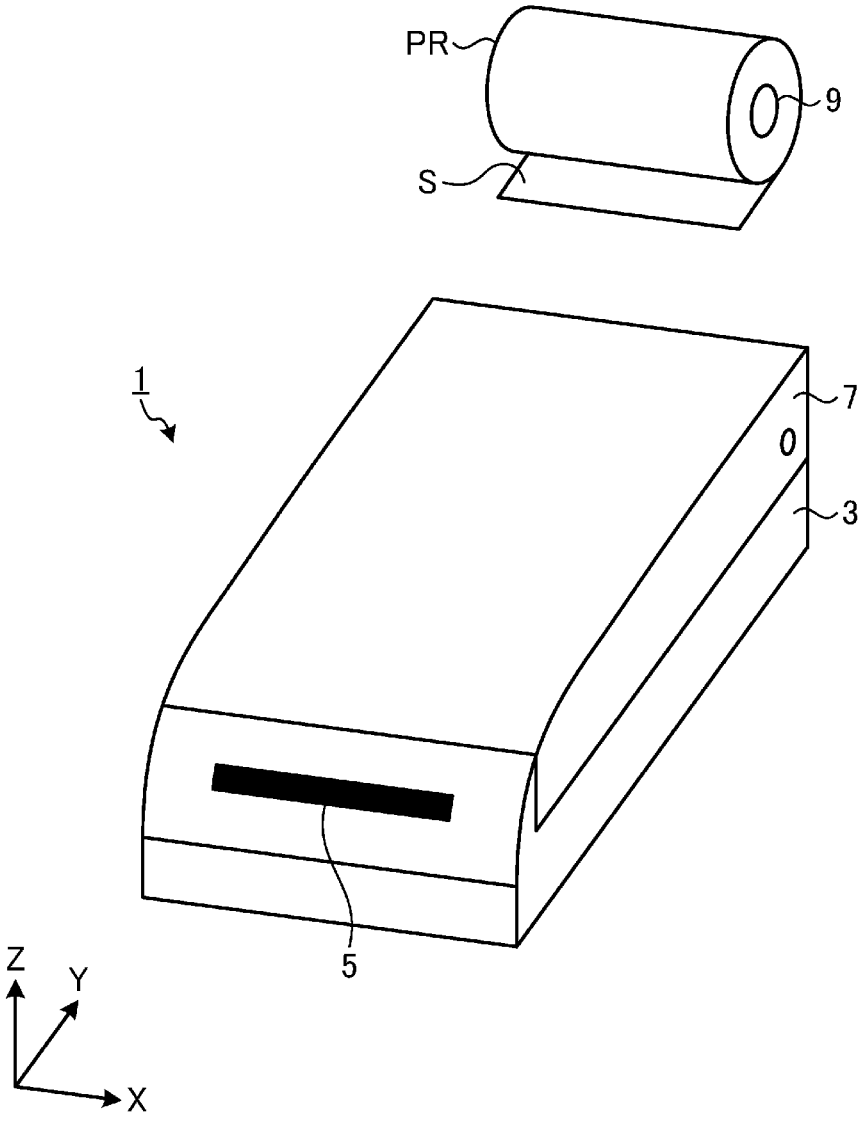
FIG. 1 is a perspective view showing an appearance of a printer device according to an embodiment.

(Embodiment) An embodiment will be described with reference to drawings. FIG. 1 is a perspective view showing an example of an outline of an appearance of a printer device 1 according to the embodiment. In the following description, an orthogonal coordinate system composed of an X-axis, a Y-axis, and a Z-axis is used. In the figure, directions indicated by arrows are positive directions. An X-axis positive direction is a left direction, and an X-axis negative direction is a right direction. In addition, a Y-axis positive direction is a rear side of the printer device 1, and a Y-axis negative direction is a front side of the printer device 1. In addition, a Z-axis positive direction is an upward direction, and a Z-axis negative direction is a downward direction.

The appearance of the printer device 1 includes a lower cover 3, a discharge port 5 for discharging a continuous paper S, and an upper cover 7. The printer device 1 can be equipped with a roll paper PR inside.

The roll paper PR is a roll-shaped printing medium (also referred to as a recording medium) in which the continuous paper S is wound around a hollow core portion 9. The core portion 9 corresponds to a tubular portion at a winding center of the continuous paper S. The roll paper PR is, for example, a receipt roll or a label roll. The receipt roll is formed by winding a strip-shaped continuous paper S serving as a receipt. The label roll is formed by winding a label with a backing paper (label paper) having a label attached to the strip-shaped continuous paper S. The printer device 1 takes out the continuous paper S from the roll paper PR and prints information such as a transaction receipt.

Figure 2:
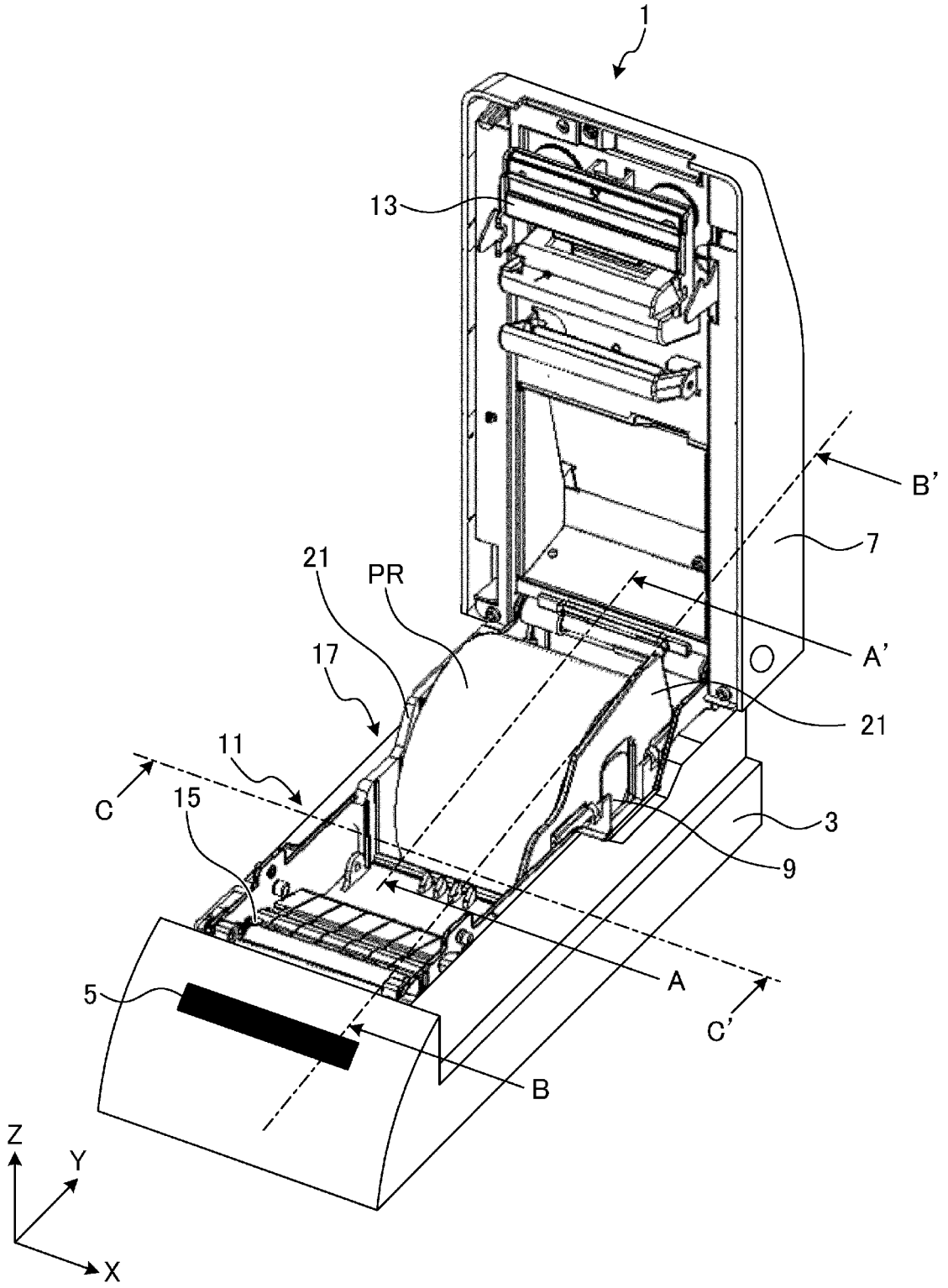
FIG. 2 is a perspective view showing a state in which an upper cover is opened.

FIG. 2 is a perspective view showing a state in which the upper cover 7 of the printer device 1 is opened. The printer device 1 includes a printer main body 11, a thermal head 13, a platen roller 15, and an accommodation part 17. As shown in FIG. 1 and FIG. 2, the lower cover 3 and the upper cover 7 cover the printer main body 11 and the accommodation part 17.

The lower cover 3 is a rectangular parallelepiped case with an open upper surface. The substantially upper surface of the printer main body 11 can be opened and closed by the upper cover 7. In addition, the lower cover 3 is provided with a connection terminal (not shown) used for connection between the internal printer main body 11 and an external device, a power supply terminal (not shown) for supplying power to the printer main body 11, the accommodation part 17 including a pair of paper guides 21, and the like. The recessed accommodation part 17 accommodates the roll-shaped continuous paper S.

The discharge port 5 is provided on the front surface of the lower cover 3. The discharge port 5 is opened in a horizontal direction so as to discharge the continuous paper S in a front surface of the printer device 1. The appearance shown in FIG. 1 is merely an example, and various modifications are possible.

The upper cover 7 is mounted to the lower cover 3 so as to be rotatable about an X-axis direction as a rotation axis on one side of a back surface side of the upper cover 7. The upper cover 7 opens and closes the opening of the upper surface of the lower cover 3 in accordance with rotation of the upper cover 7 with respect to the rotation axis.

The thermal head 13 is fixed to, for example, an inner surface of the upper cover 7. The thermal head 13 is in close contact with the platen roller 15 in a state where the opening on the upper surface of the lower cover 3 is closed by the upper cover 7. The thermal head 13 includes a plurality of heating elements provided in parallel, and prints information on a paper sandwiched between the thermal head 13 and the platen roller 15 by the heat of the heating elements.

The platen roller 15 rotates by transmitting a driving force of a stepping motor (not shown) to convey the paper sandwiched between the platen roller 15 and the thermal head 13.

Figure 3:
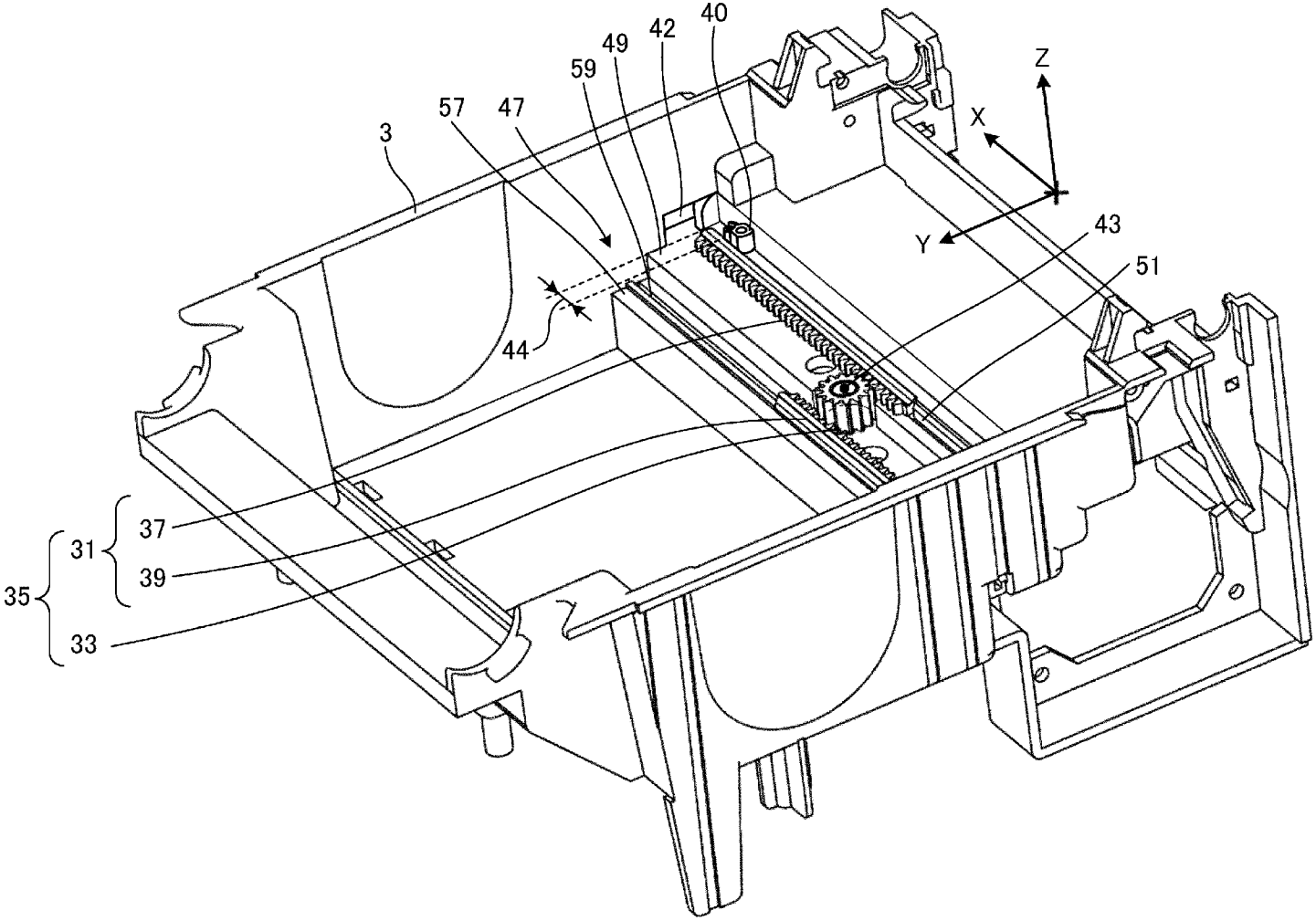
FIG. 3 is an example of a perspective view in which a rack-and-pinion cover and a pair of paper guides supporting side surfaces of a roll-shaped continuous paper are removed from a lower cover.
Figure 4:
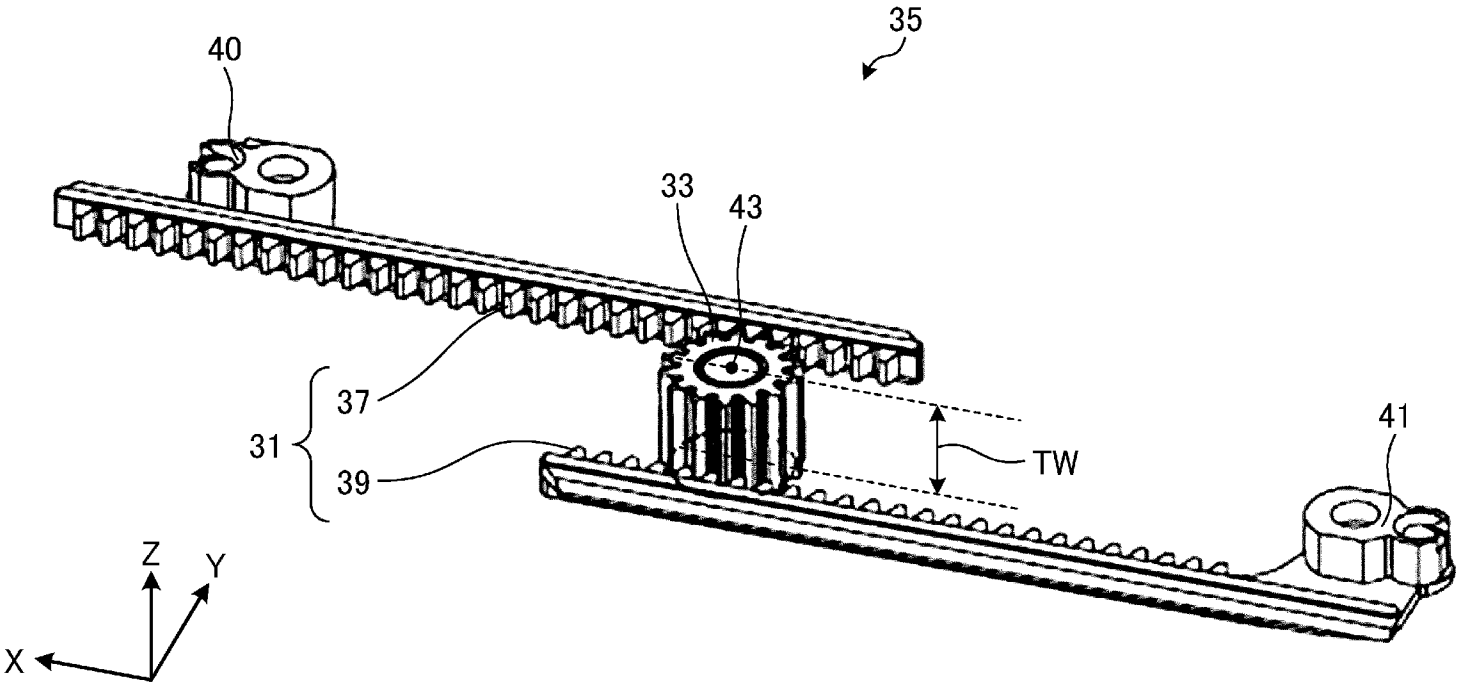
FIG. 4 is an example of a perspective view showing an example of a rack and pinion.

FIG. 3 is an example of a perspective view in which a cover (hereinafter, referred to as a rack-and-pinion cover) that covers a rack and pinion 35 having a pair of rack gears 31 and a pinion gear 33 and the pair of paper guides 21 that support the side surfaces of the roll-shaped continuous paper S are removed from the lower cover 3 of the printer device 1. FIG. 4 is an example of a perspective view showing an example of the rack and pinion 35 shown in FIG. 3. In addition, FIG. 5 is a diagram showing an example of the rack and pinion 35 shown in FIGS. 3 and 4 viewed from the back surface side of the printer device 1.

Figure 5:
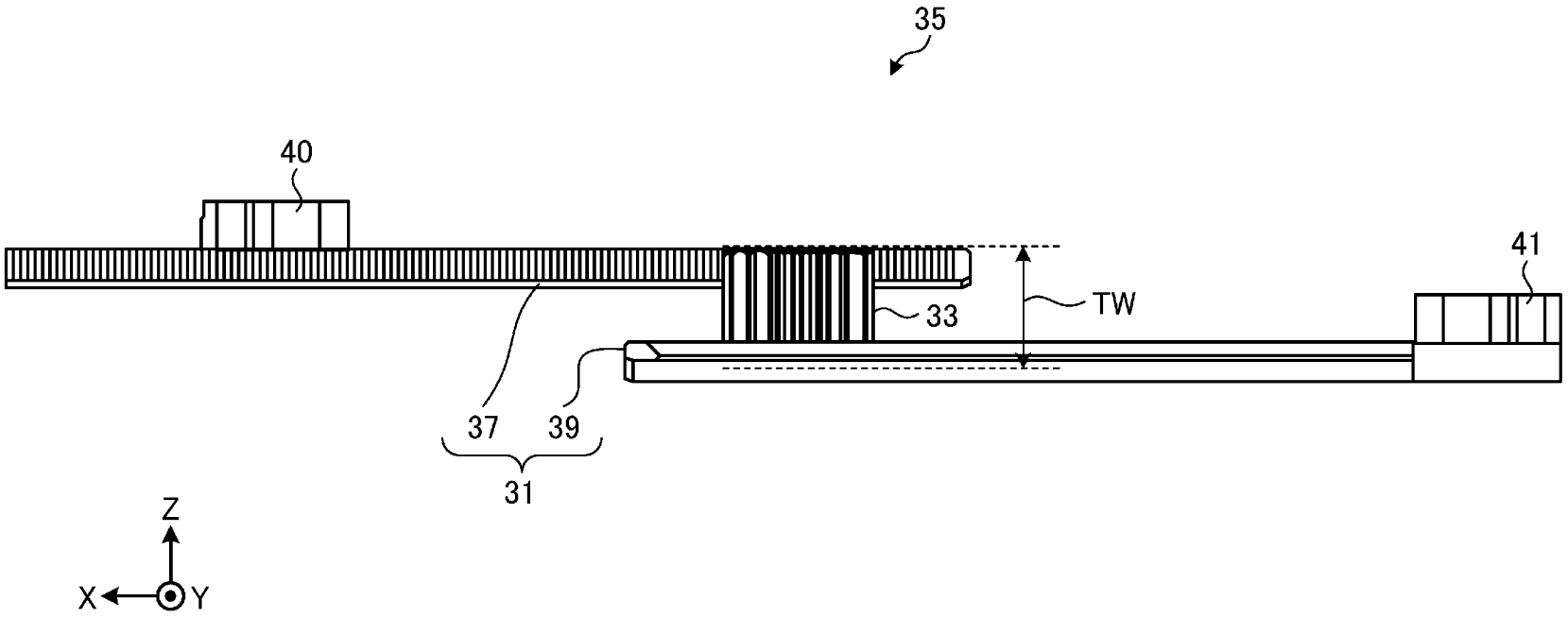
FIG. 5 is a diagram showing an example of the rack and pinion viewed from a back surface side of the printer device.

As shown in FIGS. 3 to 5, the pair of rack gears 31 in the rack and pinion 35 are arranged in a staircase-like shape on the paper conveyance direction side of the continuous paper S accommodated in the accommodation part 17. That is, the pair of rack gears 31 are arranged in the staircase-like shape at different heights along a vertical direction. In other words, although a normal rack and pinion is arranged on the same plane, in the present embodiment, as shown in FIG. 3, a rack (a rack on a left side of FIG. 3, that is, an upper rack to be described later) 37 in the X-axis positive direction (left direction) and a rack (a rack on a right side of FIG. 3, that is, a lower rack to be described later) 39 in the X-axis negative direction (right direction) are respectively arranged on two stepped planes formed in a staircase-like shape such that the arrangement heights of these racks change. The pair of rack gears 31 have tooth rows arranged in a first direction orthogonal to the paper conveyance direction so as to face each other. As shown in FIGS. 3 to 5, the first direction corresponds to the X-axis positive direction.

As shown in FIGS. 3 to 5, the pinion gear 33 is arranged between the pair of rack gears 31 and fits into the tooth rows of the pair of rack gears 31. Specifically, the pinion gear 33 has a tooth width TW that can be fitted to the upper rack gear (hereinafter, referred to as an upper rack) 37 and the lower rack gear (hereinafter, referred to as a lower rack) 39. As shown in FIGS. 4 and 5, the tooth width TW along the vertical direction in the pinion gear 33 has a length including a tooth width of the pair of rack gears 31 and a distance between the upper rack 37 and the lower rack 39 along the vertical direction. As shown in FIG. 3, the lower cover 3 has an opening 42 into which the upper rack 37 can be inserted at a position where the opening 42 faces the upper rack 37.

The pair of paper guides 21 are respectively provided at a position of the upper rack 37 that is closer to a center side in the first direction from one end portion in the first direction and a position of the lower rack gear that is closer to the center side in the first direction from another end portion in the first direction or the other end portion, among the pair of rack gears 31. Specifically, one paper guide of the pair of paper guides, which is provided on the upper rack 37 (hereinafter, referred to as an upper paper guide), is mounted to a mounting part (hereinafter, referred to as an upper mounting part) 40 extending (offsetting) from a back surface of the upper rack gear 37 opposite to the tooth row to the paper conveyance direction side. In addition, another paper guide of the pair of paper guides is mounted to a mounting part (hereinafter, referred to as a lower mounting part) 41 extending (offsetting) to the tooth row side of the other end portion in the lower rack 39 or the lower mounting part 41 extending (offsetting) to a back surface of the lower rack 39 opposite to the tooth row.

In other words, the pair of paper guides 21 are arranged on the pair of rack gears 31 via the upper mounting part 40 and the lower mounting part 41. The pair of paper guides 21 support the side surfaces of the continuous paper S accommodated in the accommodation part 17. The pair of paper guides 21 perform an opening or closing movement in the first direction by the pair of rack gears 31 and the pinion gear 33. The upper rack 37 and the lower rack 39 may be formed integrally with the paper guides 21. At this time, the upper mounting part 40 and the lower mounting part 41 are not required. In addition, the paper guide of the pair of paper guides 21, which is mounted to the lower rack 39, may be provided at a position on the back surface on the opposite side to the tooth row, that is, a position offset in a direction (Y-axis positive direction) opposite to the pinion gear 33, at a position closer to the center side in the first direction from the other end portion of the lower rack 39 in the first direction.

Figure 6:
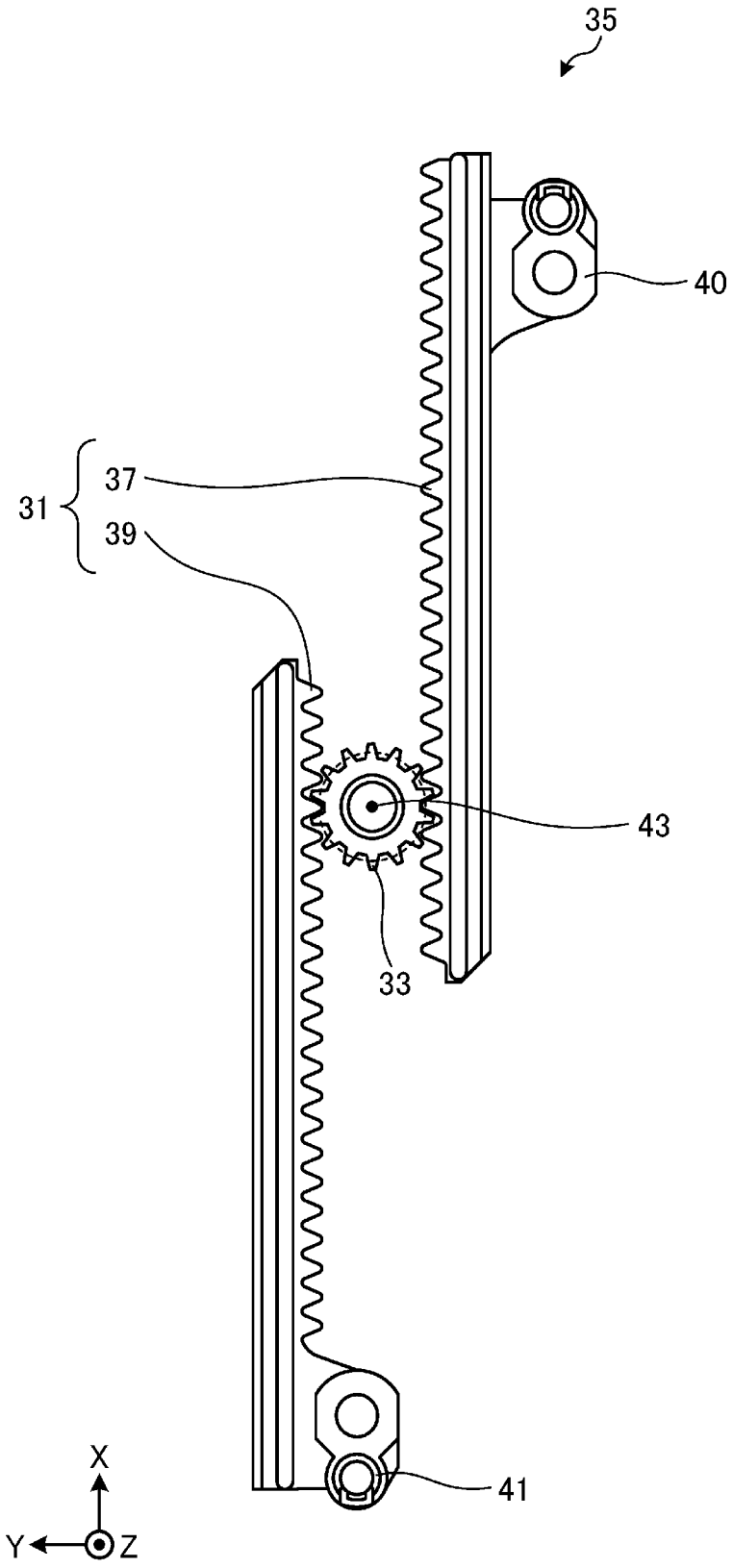
FIG. 6 is a diagram showing an example of an upper surface of the rack and pinion.

FIG. 6 is a diagram showing an example of an upper surface of the rack and pinion 35 shown in FIGS. 3 to 5. As shown in FIGS. 4 to 6, the upper mounting part 40 in the upper rack 37 is offset in the Y-axis negative direction, and the lower mounting part 41 in the lower rack 39 is offset toward the pinion gear 33 side. In addition, as shown in FIG. 6, the upper mounting part 40 in the upper rack 37, the lower mounting part 41 in the lower rack 39, and a position of a rotation axis 43 of the pinion gear 33 (hereinafter, referred to as a pinion rotation axis) are not arranged on a straight line parallel to the first direction.

Figure 7:
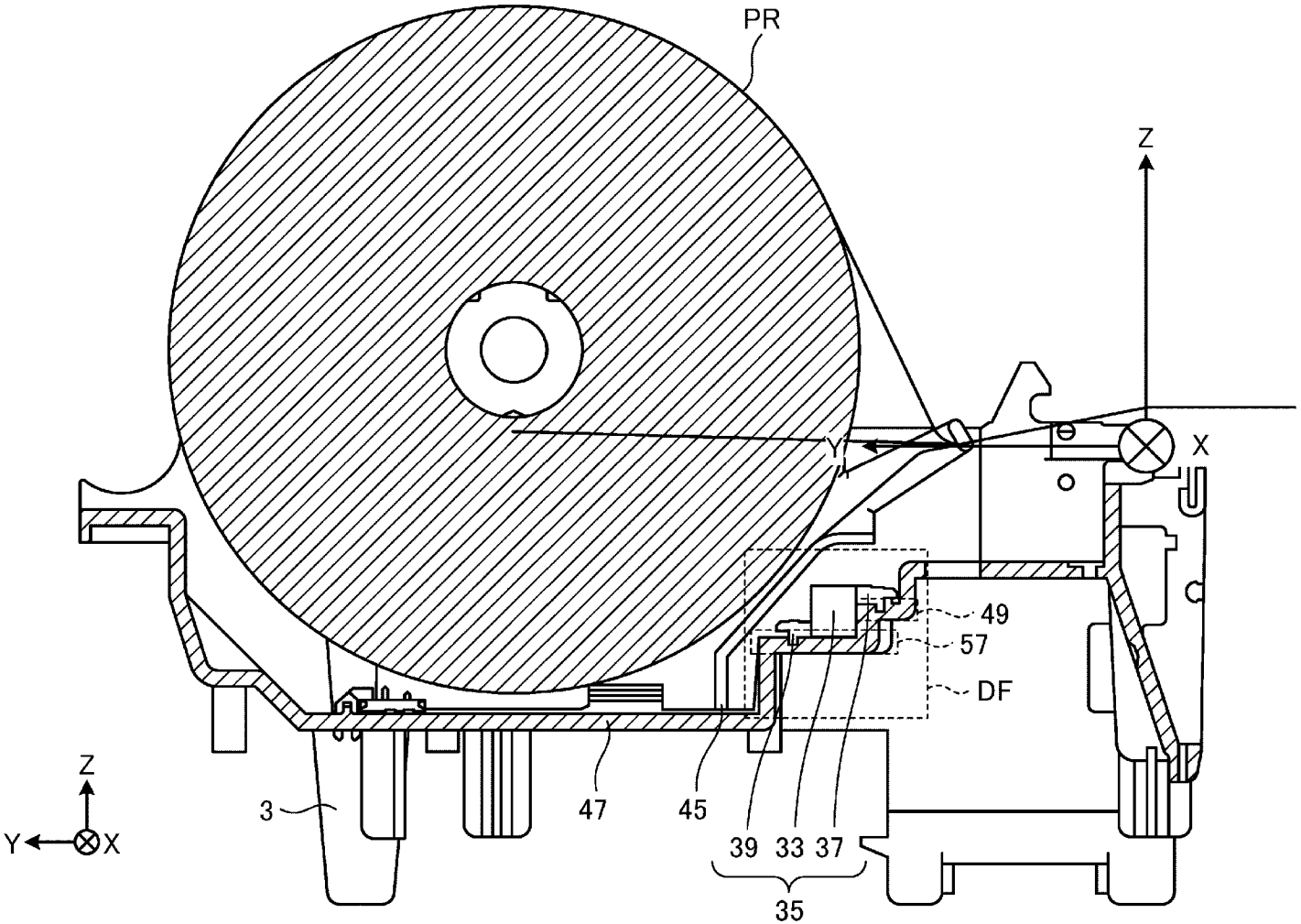
FIG. 7 is an example of a cross-sectional view taken across a line A-A' in FIG. 2 with respect to the printer device accommodating a roll paper.
Figure 8:
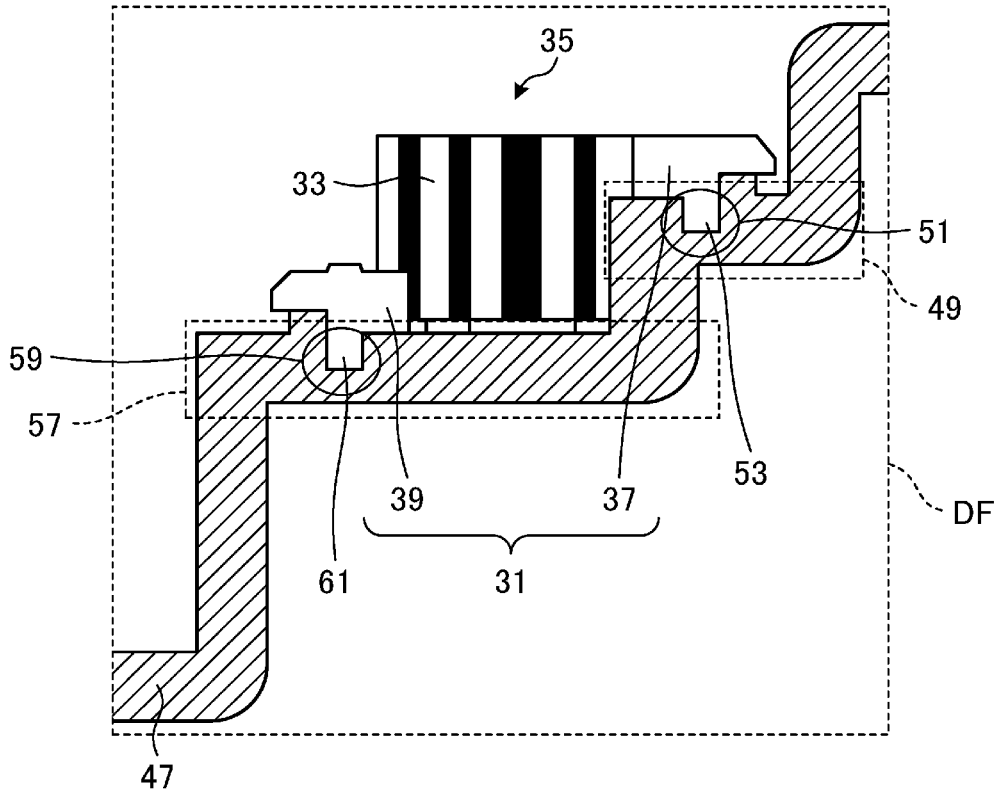
FIG. 8 is a diagram showing an example in which a portion excluding the rack-and-pinion cover is enlarged in a frame of a dotted line in FIG. 7.

FIG. 7 is an example of a cross-sectional view taken across a line A-A' in FIG. 2 with respect to the printer device 1 accommodating the roll paper PR. FIG. 8 is a diagram showing an example in which a portion excluding a rack-and-pinion cover 45 is enlarged in a frame DF of a dotted line in FIG. 7.

As shown in FIGS. 3, 7, and 8, the rack and pinion 35 is arranged on a frame 47. The frame 47 is provided on the lower cover 3. Specifically, as shown in FIG. 3, the upper rack 37 is fitted to a slide groove 51 provided in an upper portion (hereinafter, referred to as an upper plane) 49 of the staircase-like shape frame 47 so as to be movable in the X-axis direction.

As shown in FIGS. 7 and 8, the upper rack 37 has a rib 53 along the X-axis direction. The rib 53 in the upper rack 37 is fitted into the slide groove 51 provided in the upper plane 49. Therefore, the upper rack 37 is fixed to the upper plane 49 of the frame 47. Therefore, a positional relationship between the upper rack 37 and the pinion gear 33 is maintained constant.

An elastic body that biases the upper rack 37 may be provided between the upper rack 37 and the upper plane 49 of the frame 47 in a direction (X-axis negative direction) from the upper mounting part 40 toward the pinion gear 33 in the upper rack 37. Specifically, the elastic body is provided between the frame 47 at a position between the lower cover 3 on the X-axis negative direction side and the pinion gear 33 (hereinafter, referred to as an elastic body fixing position) and the upper rack 37. Therefore, the elastic body biases the upper rack 37 in the direction (X-axis negative direction) from the upper mounting part 40 of the upper rack 37 toward the pinion gear 33.

Figure 9:
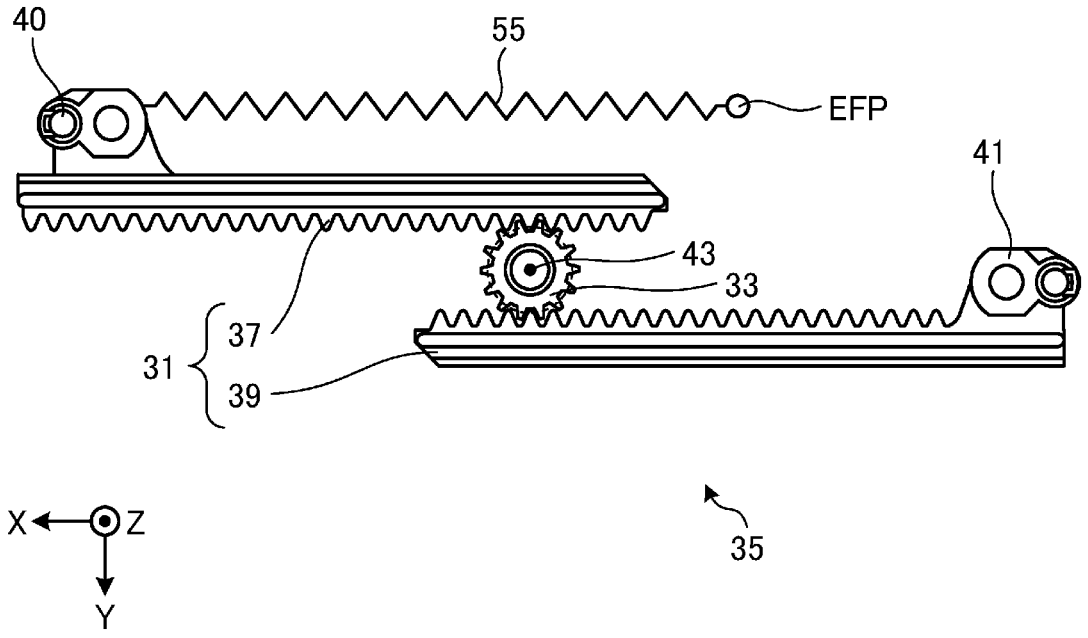
FIG. 9 is a diagram showing an example of a mounting part which is an end portion of an upper rack and an elastic body fixing position on a frame.

FIG. 9 is a diagram showing an example of the upper mounting part 40 of the upper rack 37 and an elastic body fixing position EFP in the frame 47 (not shown) in FIG. 9. As shown in FIG. 9, the elastic body 55 biases the upper rack 37 from the upper mounting part 40 along the X-axis negative direction. The elastic body 55 is realized by a spring, for example, as shown in FIG. 9. A part for realizing the elastic body 55 is not limited to the spring, and can be appropriately realized by, for example, a member having an elastic force such as rubber.

In addition, as shown in FIGS. 3, 7, and 8, the lower rack 39 is fitted to the slide groove 59 provided in a lower portion (hereinafter, referred to as a lower plane) 57 of the staircase-like shape frame 47 so as to be movable in the X-axis direction. Further, the lower rack 39 has a rib 61 along the X-axis direction. The rib 61 in the lower rack 39 is fitted into the slide groove 59 provided in the lower plane 57. Therefore, the lower rack 39 is fixed to the lower plane 57 of the frame 47. Therefore, a positional relationship between the lower rack 39 and the pinion gear 33 is maintained constant.

As shown in FIGS. 3, 7, and 8, the pinion gear 33 is installed so as to be rotatable about the vertical direction as the rotation axis on the pinion rotation axis 43 on the lower plane 57 of the staircase-like shape frame 47. In addition, as shown in FIGS. 3 to 8, teeth of the pinion gear 33 are fitted with teeth of the pair of rack gears 31. Since the pair of rack gears 31 are fixed to the frame 47 via the rib 53 and the rib 61, the pinion gear 33 smoothly transmits a force applied to the upper rack 37 to the lower rack 39. As a result, the upper rack 37 and the lower rack 39 slide along the X-axis direction in conjunction with an operation of a user on the upper rack 37.

Figure 10:
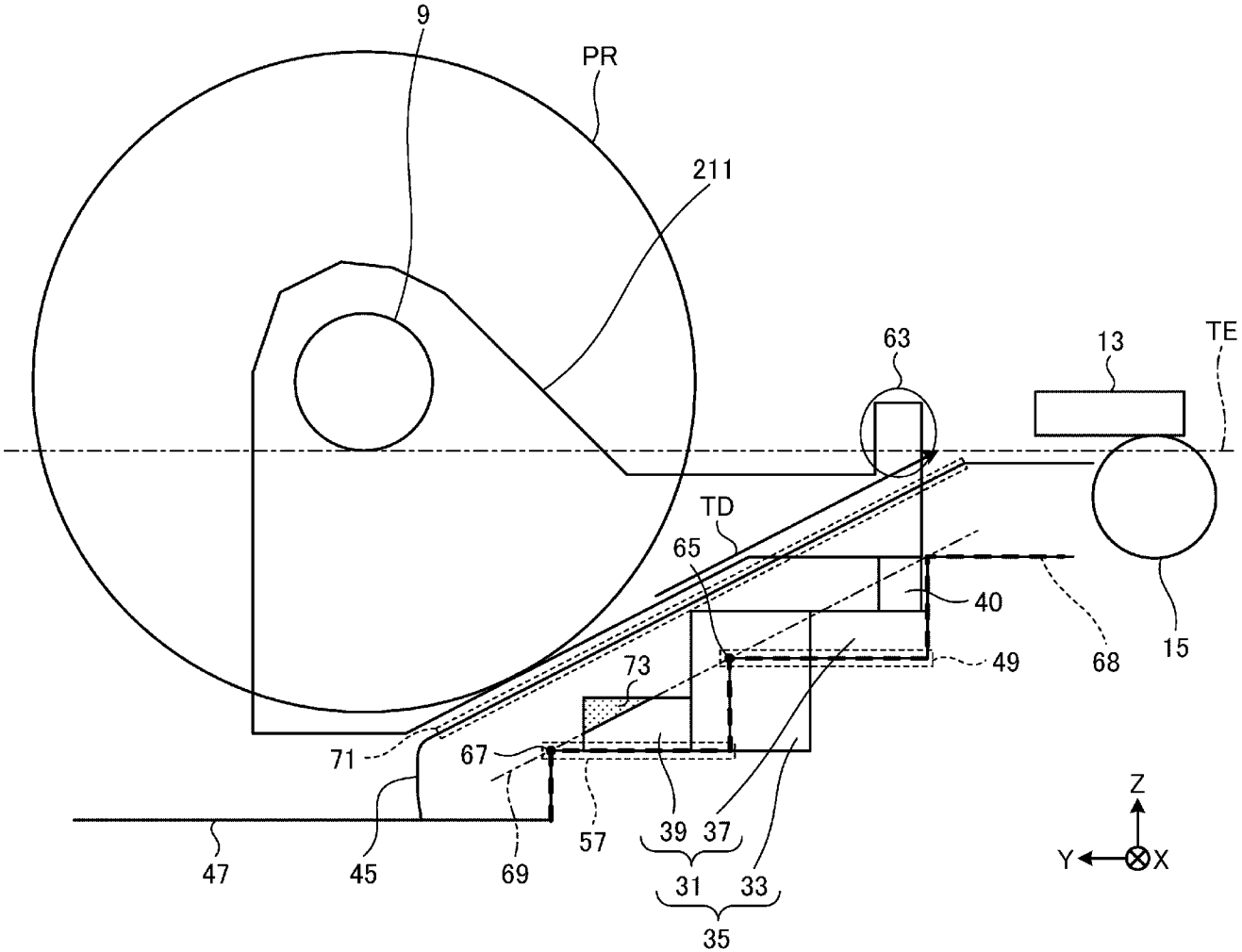
FIG. 10 is an example of a cross-sectional view taken across a line B-B' in FIG. 2 with respect to the printer device.

FIG. 10 is an example of a cross-sectional view taken across a line B-B' in FIG. 2 with respect to the printer device 1 accommodating the roll paper PR. As shown in FIG. 10, an upper paper guide 211 of the pair of paper guides 21, which is provided on the upper rack 37, includes an operation part 63 for performing an opening or closing movement of the pair of paper guides 21. That is, the operation part 63 for operating the paper guides 21 is provided on an upper portion of the upper paper guide 211 arranged in the upper rack 37 of the pair of paper guides 21. In other words, as shown in FIG. 10, the operation part 63 is provided on the upper paper guide 211 mounted on the upper rack 37 at a high position on the two stepped planes.

At this time, the operation part 63 operates the pair of paper guides 21 in conjunction with each other under the operation of the user. Specifically, the operation by the operation part 63 is transmitted to the lower rack 39 via the upper rack 37 and the pinion gear 33. As a result, the pair of paper guides 21 are in conjunction with each other under the operation of the operation part 63. The rack and pinion 35 and the pair of paper guides 21 correspond to sliding parts that can slide along the X-axis direction.

As shown in FIG. 10, the operation part 63 is arranged in the vicinity of the sliding part. Specifically, it is preferable that the operation part 63 is arranged on the upper paper guide 211 so as to protrude upward (in the Z-axis positive direction) from an upper end TE of the lower cover 3 in the vicinity of the upper rack 37.

As shown in FIGS. 3, 7, and 10, the upper plane 49 on which the upper rack 37 is arranged has a first corner portion 65 at an end portion in a second direction (Y-axis positive direction) orthogonal to the first direction. In addition, the lower plane 57 on which the lower rack 39 is arranged has a second corner portion 67 at the end portion in the second direction. The rack-and-pinion cover 45 has an inclined surface 71 parallel to a straight line (hereinafter, referred to as a corner portion straight line) 69 connecting the first corner portion 65 and the second corner portion 67 on the dotted line in a staircase-like shape 68. That is, the inclined surface 71 is parallel to the corner portion straight line 69 connecting the first corner portion 65 and the second corner portion 67.

As shown in FIGS. 3 and 10, the pair of paper guides 21 are in conjunction with each other in the horizontal direction (X-axis direction) by the operation of the use via the operation part 63 along the inclined surface 71 defined by the upper rack 37 and the lower rack 39 in the pair of rack gears 31 by the pair of rack gears 31 and the pinion gear 33.

In other words, the lower rack 39 of the two stepped planes (the upper plane 49 and the lower plane 57) in the staircase-like shape 68, which is arranged on the lower plane 57, has a protruding portion 73 protruding from the corner portion straight line 69 as compared with the upper rack 37. Therefore, the pair of paper guides 21 move in conjunction with each other on the left and right so as to be slidable in the X axis direction along an inclined wall surface (inclined surface 71) substantially parallel to the corner portion straight line 69 connecting the corner portions in the staircase-like shape 68. That is, the pair of paper guides 21 perform the opening or closing movement along the inclined surface defined by a straight line parallel to a straight line connecting the first corner portion 65 and the second corner portion 67 and the first direction (X-axis positive direction).

With such a configuration, according to the printer device 1 of the present embodiment, the pair of rack gears 31 arranged in the staircase-like shape 68 at the different heights along the vertical direction and having the pair of paper guides 21 arranged to support the side surfaces of the roll-shaped continuous paper S and the pinion gear 33 fitted to the pair of rack gears 31 are provided, and the pair of paper guides 21 are in conjunction with each other in the horizontal direction along the inclined surface 71 defined by the upper rack 37 and the lower rack 39 in the pair of rack gears 31 by the pair of rack gears 31 and the pinion gear 33.

At this time, the inclined surface 71 is parallel to the corner portion straight line 69 that connects the first corner portion 65 positioned at the end portion in the second direction in the upper plane 49 on which the upper rack 37 is arranged and the second corner portion 67 positioned at the end portion in the second direction in the lower plane 57 on which the lower rack 39 is arranged.

In addition, according to the printer device 1 of the present embodiment, the operation part 63 for operating the opening and closing movement of the pair of paper guides 21 is provided above the upper paper guide 211 arranged on the upper rack 37 of the pair of paper guides 21. At this time, as shown in FIG. 10, the operation part 63 projects upward from the upper end TE of the lower cover 3.

Figure 11:
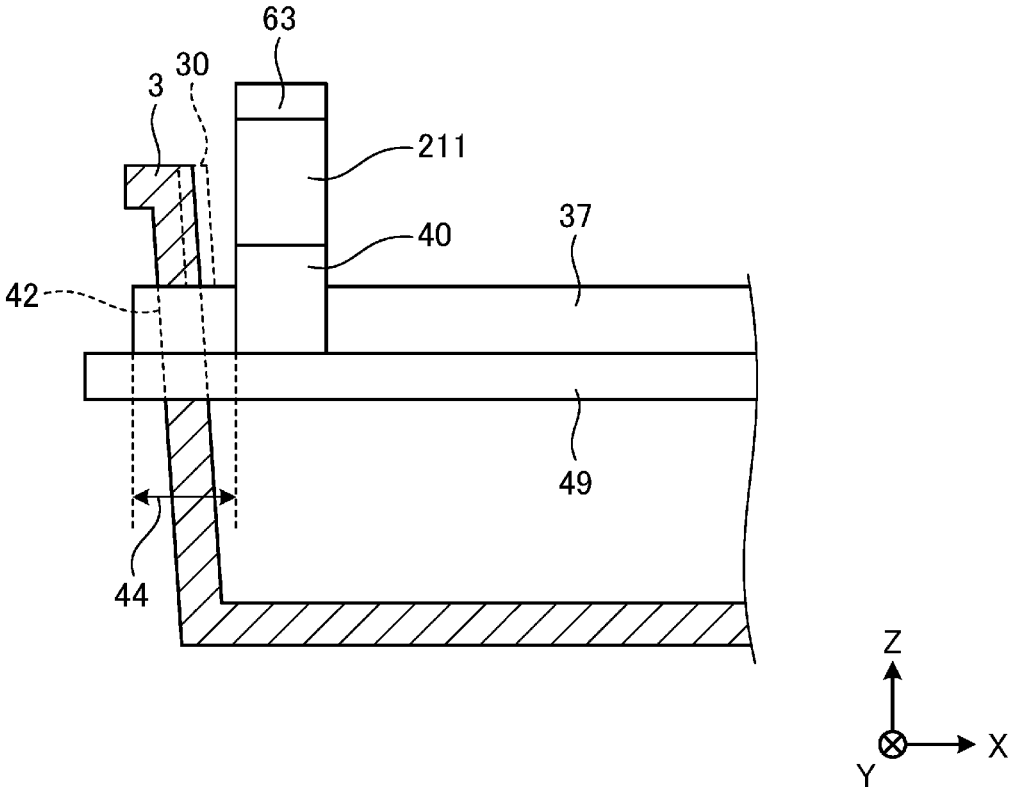
FIG. 11 is an example of a cross-sectional view taken across a line C-C' in FIG. 2.

FIG. 11 is an example of a cross-sectional view taken across a line C-C' in FIG. 2 with respect to the printer device 1 accommodating the roll paper PR. As shown in FIGS. 11 and 3, the upper paper guide 211 of the pair of paper guides 21, which is provided on the upper rack 37, includes the operation part 63 for performing the opening and closing movement of the pair of paper guides 21. That is, the operation part 63 is provided on the upper paper guide 211 mounted on the upper rack 37 at the high position on the two stepped planes.

In addition, as shown in FIGS. 11 and 3, the upper mounting part 40 in the upper rack 37 is provided on a side (a paper conveyance direction side TD side) opposite to the pinion gear 33 at the position closer to the center side in the first direction from the end portion of the upper rack 37 on the wall surface side of the lower cover 3. Thus, as shown in FIGS. 3 and 11, the upper rack 37 has a portion (hereinafter, referred to as an extra length portion) 44 having the tooth row between the end portion of the upper rack 37 on the wall surface side of the lower cover 3 and the upper mounting part 40.

As shown in FIGS. 11 and 3, the lower cover 3 has the opening 42 into which the upper rack 37 can be inserted at the position where the opening 42 faces the upper rack 37. The upper plane 49 projects from the opening 42 toward the outside of the lower cover 3 so that the upper rack 37 protruding from the opening can be supported. A length of the upper plane 49 protruding from the opening 42 corresponds to, for example, a length obtained by subtracting a thickness of the lower cover 3 in the opening 42 from a length of the extra length portion 44. As a result, when the operation part 63 is moved to a tapered portion 30 of the lower cover 3 along the X-axis positive direction, the upper plane 49 supports the extra length portion 44 in the upper rack 37 even outside the opening 42. That is, when the extra length portion 44 projects from the opening 42 to the outside of the printer main body 11, the extra length portion 44 is supported by the upper plane 49. Therefore, as shown in FIG. 11, in the opening 42, the upper rack 37 is further surrounded by the lower cover 3 and the upper plane 49.

Therefore, according to the printer device 1 of the present embodiment, the rack and pinion 35 is arranged at a different height in the staircase-like shape 68, a portion of the upper paper guide 211 mounted on the upper rack 37 arranged at the upper portion in the staircase-like shape 68 is set as the operation part 63, and the upper paper guide 211 is provided at the position offset to the paper conveyance direction TD side and closer to the center side in the first direction from the end portion of the upper rack 37, and is mounted on the upper mounting part 40 extending from the back surface on the opposite side of the tooth row of the upper rack 37 to the paper conveyance direction side. As a result, the sliding part related to the slide of the paper guides 21 is arranged in the vicinity of the operation part 63. That is, since the operation part 63 is arranged in the vicinity of the sliding part having the upper rack 37, the user can smoothly move the paper guides 21 via the operation part 63.

As described above, according to the printer device 1 according to the present embodiment, the operation part 63 that can be operated without interfering with the roll paper PR can be installed in the vicinity of the sliding part, and the printer device 1 can be miniaturized.

In addition, according to the printer device 1 according to the present embodiment, the elastic body 55 that biases the upper rack 37 is further provided in the direction (X-axis negative direction) from the upper mounting part 41 of the upper rack 37 toward the pinion gear 33. Therefore, the user can set the roll paper PR in the accommodation part 17 by a simple operation of moving the operation part 63 provided on the upper rack 37 in the X-axis positive direction.

In addition, according to the printer device 1 according to the present embodiment, the upper rack 37 has the extra length portion 44, and the lower cover 3 has the opening 42 into which the upper rack 37 can be inserted at the position where the opening 42 faces the upper rack 37. As a result, when the upper rack 37 is inserted into the opening 42, as shown in FIG. 11, the extra length portion 44 of the upper rack 37 is sandwiched between the lower cover 3 and the upper plane 49. Therefore, in an opening operation of the pair of paper guides 21, a torque generated in the upper rack 37 with the Y-axis direction as the rotation axis can be suppressed. Accordingly, even when a rigidity of the upper rack 37 of an elongated structure along the first direction is lower than that of the upper paper guide 211 with a high rigidity, an inclination and deflection of the upper rack 37 with respect to the first direction can be suppressed, and a biting of the upper rack 37 with respect to the pinion gear 33 can be prevented or suppressed. As described above, according to the printer device 1, in addition to the fact that the operation part 63 is arranged in the vicinity of the sliding part, for example, when the roll paper PR is set in the accommodation part 17, the pair of paper guides 21 can be smoothly moved, and an operability can be improved.

As described above, according to the printer device 1 according to the present embodiment, for example, compared to manufacturing of a frame in a case where a short axis of the rack and pinion 35, that is, a width of the rack and pinion 35 in a plane perpendicular to the pinion rotation axis 43 of the pinion gear 33, is inclined from a horizontal plane in the paper conveyance direction TD, the number of parts and the number of man-hours of a mold can be reduced, and the printer device 1 can be manufactured at a low cost.

In addition, according to the printer device 1, the operation part 63 can be arranged at a position protruding upward (Z-axis positive direction) from the upper end of the lower cover 3 in the vicinity of the sliding part without providing the operation part 63 in the vicinity of a bottom surface of the lower cover 3. Therefore, in attachment and detachment of the roll paper PR to and from the accommodation part 17, a space for inserting a finger or the like of the user into the accommodation part 17 is not necessary. As described above, according to the present printer device 1, the printer main body 11 can be miniaturized. Further, according to the present printer device 1, since an access to the operation part 63 by the user is improved, the operability can be improved in the attachment and detachment the roll paper PR to and from the accommodation part 17.

While several embodiments have been described, these embodiments have been presented by way of example and are not intended to limit the scope of the disclosure. These novel embodiments can be implemented in other various forms, and various omissions, replacements, and changes can be made without departing from the spirit of the disclosure. The accompanying claims and there equivalents are intended to cover such forms or modifications as would fall within the scope and spirit of the disclosure.

What is claimed is:

1. A printer device, comprising:

a recessed accommodation part that accommodates a roll-shaped continuous paper;

a pair of rack gears arranged in a staircase-like shape on a paper conveyance direction side of the roll-shaped continuous paper accommodated in the accommodation part and having tooth rows arranged in a first direction orthogonal to the paper conveyance direction so as to face each other;

a pinion gear arranged between the pair of rack gears and configured to fit into the tooth rows of the pair of rack gears; and a pair of paper guides respectively provided at a position of an upper rack gear of the pair of rack gears closer to a center side in the first direction from one end portion in the first direction and a position of a lower rack gear of the pair of rack gears closer to the center side in the first direction from another end portion in the first direction or the other end portion, and support side surfaces of the roll-shaped continuous paper accommodated in the accommodation part by an opening or closing movement in the first direction by the pair of rack gears and the pinion gear, wherein a paper guide of the pair of paper guides, which is provided on the upper rack gear, is mounted to an upper mounting part extending from a back surface of the upper rack gear opposite to the tooth row to the paper conveyance direction side, wherein the upper mounting part is offset away from the pinion gear.

2. The printer device according to claim 1, wherein an upper paper guide of the pair of paper guides, which is provided on the upper rack gear, further includes an operation part for performing the opening or closing movement.

3. The printer device according to claim 2, wherein an upper plane on which the upper rack gear is arranged has a first corner portion at an end portion in a second direction orthogonal to the first direction, a lower plane on which the lower rack gear is arranged has a second corner portion at the end portion in the second direction, and the pair of paper guides perform the opening or closing movement along an inclined surface defined by a straight line parallel to a straight line connecting the first corner portion and the second corner portion and the first direction.

4. The printer device according to claim 1, wherein an upper plane on which the upper rack gear is arranged has a first corner portion at an end portion in a second direction orthogonal to the first direction, a lower plane on which the lower rack gear is arranged has a second corner portion at the end portion in the second direction, and the pair of paper guides perform the opening or closing movement along an inclined surface defined by a straight line parallel to a straight line connecting the first corner portion and the second corner portion and the first direction.

5. The printer device according to claim 1, further comprising:

a lower cover provided with the accommodation part, wherein the lower cover has an opening into which the upper rack gear is insertable at a position where the opening faces the upper rack gear.

6. The printer device according to claim 1, further comprising:

an elastic body configured to bias the upper rack gear in the direction from the upper mounting part toward the pinion gear.

7. A thermal printer, comprising:

a thermal printing head;

a recessed accommodation part that accommodates a roll-shaped continuous paper;

a pair of rack gears arranged in a staircase-like shape on a paper conveyance direction side of the roll-shaped continuous paper accommodated in the accommodation part and having tooth rows arranged in a first direction orthogonal to the paper conveyance direction so as to face each other;

a pinion gear arranged between the pair of rack gears and configured to fit into the tooth rows of the pair of rack gears; and a pair of paper guides respectively provided at a position of an upper rack gear of the pair of rack gears closer to a center side in the first direction from one end portion in the first direction and a position of a lower rack gear of the pair of rack gears closer to the center side in the first direction from another end portion in the first direction or the other end portion, and support side surfaces of the roll-shaped continuous paper accommodated in the accommodation part by an opening or closing movement in the first direction by the pair of rack gears and the pinion gear, wherein a paper guide of the pair of paper guides, which is provided on the upper rack gear, is mounted to an upper mounting part extending from a back surface of the upper rack gear opposite to the tooth row to the paper conveyance direction side, wherein the upper mounting part is offset away from the pinion gear.

8. The thermal printer according to claim 7, wherein an upper paper guide of the pair of paper guides, which is provided on the upper rack gear, further includes an operation part for performing the opening or closing movement.

9. The thermal printer according to claim 8, wherein an upper plane on which the upper rack gear is arranged has a first corner portion at an end portion in a second direction orthogonal to the first direction, a lower plane on which the lower rack gear is arranged has a second corner portion at the end portion in the second direction, and the pair of paper guides perform the opening or closing movement along an inclined surface defined by a straight line parallel to a straight line connecting the first corner portion and the second corner portion and the first direction.

10. The thermal printer according to claim 7, wherein an upper plane on which the upper rack gear is arranged has a first corner portion at an end portion in a second direction orthogonal to the first direction, a lower plane on which the lower rack gear is arranged has a second corner portion at the end portion in the second direction, and the pair of paper guides perform the opening or closing movement along an inclined surface defined by a straight line parallel to a straight line connecting the first corner portion and the second corner portion and the first direction.

11. The thermal printer according to claim 7, further comprising:

a lower cover provided with the accommodation part, wherein the lower cover has an opening into which the upper rack gear is insertable at a position where the opening faces the upper rack gear.

12. The thermal printer according to claim 7, further comprising:

an elastic body configured to bias the upper rack gear in the direction from the upper mounting part toward the pinion gear.

13. A portable printer, comprising:

a recessed accommodation part that accommodates a roll-shaped continuous paper;

a pair of rack gears arranged in a staircase-like shape on a paper conveyance direction side of the roll-shaped continuous paper accommodated in the accommodation part and having tooth rows arranged in a first direction orthogonal to the paper conveyance direction so as to face each other;

a pinion gear arranged between the pair of rack gears and configured to fit into the tooth rows of the pair of rack gears; and a pair of paper guides respectively provided at a position of an upper rack gear of the pair of rack gears closer to a center side in the first direction from one end portion in the first direction and a position of a lower rack gear of the pair of rack gears closer to the center side in the first direction from another end portion in the first direction or the other end portion, and support side surfaces of the roll-shaped continuous paper accommodated in the accommodation part by an opening or closing movement in the first direction by the pair of rack gears and the pinion gear, wherein a paper guide of the pair of paper guides, which is provided on the upper rack gear, is mounted to an upper mounting part extending from a back surface of the upper rack gear opposite to the tooth row to the paper conveyance direction side, wherein the upper mounting part is offset away from the pinion gear.

14. The portable printer according to claim 13, wherein an upper paper guide of the pair of paper guides, which is provided on the upper rack gear, further includes an operation part for performing the opening or closing movement.

15. The portable printer according to claim 14, wherein an upper plane on which the upper rack gear is arranged has a first corner portion at an end portion in a second direction orthogonal to the first direction, a lower plane on which the lower rack gear is arranged has a second corner portion at the end portion in the second direction, and the pair of paper guides perform the opening or closing movement along an inclined surface defined by a straight line parallel to a straight line connecting the first corner portion and the second corner portion and the first direction.

16. The portable printer according to claim 13, wherein an upper plane on which the upper rack gear is arranged has a first corner portion at an end portion in a second direction orthogonal to the first direction, a lower plane on which the lower rack gear is arranged has a second corner portion at the end portion in the second direction, and the pair of paper guides perform the opening or closing movement along an inclined surface defined by a straight line parallel to a straight line connecting the first corner portion and the second corner portion and the first direction.

17. The portable printer according to claim 13, further comprising:

a lower cover provided with the accommodation part, wherein the lower cover has an opening into which the upper rack gear is insertable at a position where the opening faces the upper rack gear.

18. The portable printer according to claim 13, further comprising:

an elastic body configured to bias the upper rack gear in the direction from the upper mounting part toward the pinion gear.

19. The portable printer according to claim 13, wherein the portable printer is a portable label printer.

20. The portable printer according to claim 13, wherein the portable printer is a portable receipt printer.

* * * * *